US007628464B2

(12) United States Patent
Nakagawa et al.

(10) Patent No.: US 7,628,464 B2
(45) Date of Patent: Dec. 8, 2009

(54) LIQUID DROP PLACING APPARATUS AND LIQUID DROP PLACING METHOD

(75) Inventors: Tohru Nakagawa, Kusatsu (JP); Norihisa Mino, Osaka (JP)

(73) Assignee: Panasonic Corporation, Osaka (JP)

( * ) Notice: Subject to any disclaimer, the term of this patent is extended or adjusted under 35 U.S.C. 154(b) by 595 days.

(21) Appl. No.: 10/568,059

(22) PCT Filed: Mar. 2, 2005

(86) PCT No.: PCT/JP2005/003514

§ 371 (c)(1),
(2), (4) Date: Feb. 13, 2006

(87) PCT Pub. No.: WO2005/090081

PCT Pub. Date: Sep. 29, 2005

(65) Prior Publication Data

US 2008/0158300 A1 Jul. 3, 2008

(30) Foreign Application Priority Data

Mar. 17, 2004 (JP) ..... 2004-077003

(51) Int. Cl.
*B41J 29/393* (2006.01)

(52) U.S. Cl. ..... 347/19; 347/67; 347/51; 347/81; 347/8

(58) Field of Classification Search ..... 347/19, 347/8, 16, 37, 81, 47, 51, 67
See application file for complete search history.

(56) References Cited

U.S. PATENT DOCUMENTS 5,658,802 A 8/1997 Hayes et al.

(Continued)

FOREIGN PATENT DOCUMENTS

JP 06143669 A * 5/1994

(Continued)

OTHER PUBLICATIONS

G.G. Rozenberg et al., "Patterned Low Temperature Copper-Rich Deposits Using Inkjet Printing" Applied Physics Letters, vol. 81, No. 27, 2002, p. 5249-5251.

(Continued)

*Primary Examiner*—Matthew Luu
*Assistant Examiner*—Henok Legesse
(74) *Attorney, Agent, or Firm*—Hamre, Schumann, Mueller & Larson, P.C.

(57) ABSTRACT

An ink jet head (1), a substrate (13) receiving a liquid drop (2) discharged from the ink jet head (1), a device for irradiating or reflecting light from a nozzle hole or its vicinity of the ink jet head (1) toward the substrate (13), a position moving device (10) for controlling a relative position between the ink jet head (1) and the substrate (13), and a control device (9) for discharging a liquid from the ink jet head (1) are included. A light-receiving element (6) for recognizing a position of the ink jet head (1) is disposed behind the substrate (13), when seen from the ink jet head (1), the substrate (13) has a transparency at least to a degree that the irradiated light or the light reflected from the nozzle hole or its vicinity toward the substrate (13) enters the light-receiving element (6), and the light-receiving element (6) senses the irradiated light or the light reflected from the nozzle hole or its vicinity toward the substrate (13). Consequently, even if the distance between the ink jet head and the substrate is small, the relative position between the ink jet head and the substrate is adjusted accurately.

10 Claims, 10 Drawing Sheets

U.S. PATENT DOCUMENTS

| | | | | |
|---|---|---|---|---|
| 6,060,113 | A * | 5/2000 | Banno et al. | 427/78 |
| 2001/0043246 | A1* | 11/2001 | Taneya et al. | 347/19 |
| 2005/0074247 | A1* | 4/2005 | Soar et al. | 399/16 |

FOREIGN PATENT DOCUMENTS

| | | |
|---|---|---|
| JP | 11-339642 | 10/1999 |
| JP | 2001-284047 | 10/2001 |
| JP | 2002-253200 | 9/2002 |
| JP | 2002-286732 | 10/2002 |
| JP | 2003-98172 | 4/2003 |

OTHER PUBLICATIONS

H.Sirringhaus et al., "High-Resolution Inkjet Printing of All-Polymer Transistor Circuits" Science, vol. 290, 2000, p. 2123-2126.

J. Bharathan et al., "Polymer Electroluminescent Devices Processed by Inkjet Printing" Applied Physics Letters, vol. 72, No. 21, 1998, p. 2660-2662.

T.R.Hebner et al., "Ink-Jet Printing of Doped Polymers for Organic Light Emitting Devices" Applied Physics Letters, vol. 72, No. 5, 1998, p. 519-521.

* cited by examiner

LIQUID DROP PLACING APPARATUS AND LIQUID DROP PLACING METHOD

TECHNICAL FIELD

The present invention relates to a liquid drop placing apparatus and a liquid drop placing method using an ink jet.

BACKGROUND ART

In recent years, ink jet printers have been utilized widely as a printer for characters and images and also come into use as apparatus for producing electronic devices and deoxyribonucleic acid (DNA) chips. Here, the electronic device refers to an element that utilizes the flow or accumulation of electrons to perform computation, information storage and transmission, display, etc. and a group of these elements. Examples thereof include electric circuits, and wirings, electrodes, resistors, capacitors and semiconductor elements constituting the electric circuits.

In the following, a general outline of the ink jet printer and an example of producing an electronic device using the ink jet printer will be described. The printing mechanism in the ink jet printer is as follows: several picoliters of ink are discharged from each of a large number of penetrating holes (in the following, referred to as "nozzle holes") with a diameter of several tens of μm provided in a flat plate (in the following, referred to as a "nozzle plate") toward a printing material such as paper so that the discharged ink is placed at predetermined positions on the printing material. In order to place the ink at predetermined positions on a recording medium, the ink is discharged while moving the positions of the nozzle and the printing material mechanically so as to control the relative positions therebetween. Such a method of discharging liquid (also referred to as liquid drops) from the nozzle holes of the nozzle plate and placing the liquid at predetermined positions on a substrate is called an ink jet method. Also, a device including a mechanism of discharging the liquid from the nozzle holes is called an ink jet head. The ink jet head includes the nozzle plate, the nozzle holes penetrating through the nozzle plate, a pressure chamber that contacts a surface of the nozzle plate opposite to a liquid discharge surface and is in communication with the nozzle holes, and a mechanism to generate pressure in the pressure chamber. By applying pressure to the pressure chamber, the liquid held in the pressure chamber is discharged from the nozzle holes to the outside of the nozzle plate.

FIG. 10 schematically shows the entire ink jet printer. An ink jet printer 100 in FIG. 10 includes an ink jet head 101 utilizing a piezoelectric effect of a piezoelectric element for recording and allows an ink drop discharged from this ink jet head to land on a recording medium 102 such as paper, thus recording on the recording medium. The ink jet head is mounted on a carriage 104 disposed in a main scanning direction X and reciprocates in the main scanning direction X as the carriage 104 reciprocates along a carriage shaft 103. Furthermore, the ink jet printer includes a plurality of rollers (a moving system) 105 for moving the recording medium relatively in a sub scanning direction Y, which is perpendicular to a width direction of the ink jet head 101 (the direction X). The ink jet head is constituted by the nozzle plate provided with the nozzle holes for discharging the ink, a driving part for discharging the ink from the nozzle and a part for supplying the ink to the nozzle.

FIGS. 11A to 11C illustrates an example of a structure of the ink jet head. FIG. 11A is a sectional view showing a nozzle hole 121 and its vicinity. The nozzle hole is in communication with a pressure chamber 113, and a diaphragm 112 and a piezoelectric element 111 are formed above the pressure chamber 113. The pressure chamber 113 is filled with ink, which is supplied from an ink flow channel 115 through an ink supply hole 114. When a voltage is applied to the piezoelectric element 111, the piezoelectric element 111 and the diaphragm 112 flex, increasing the pressure in the pressure chamber 113, so that the ink is discharged from the nozzle 121. The surface of a nozzle plate 116 is treated to be water repellent so that the ink 118 is discharged from the nozzle hole 121 in a constant direction. There also is the case of employing a method of generating air bubbles in an ink chamber for the purpose of increasing the pressure in the pressure chamber 113 (the Bubble Jet (registered trademark) method). FIG. 11B is a schematic three-dimensional perspective drawing taken along a line I-I in FIG. 11A. Although only the structure near about two nozzle holes is shown here, a large number of the same structures are aligned in practice. This figure shows the state in which a left-side piezoelectric element 117 and the diaphragm 112 flex, so that the ink 118 is discharged from the nozzle hole 121 in a direction indicated by an arrow 119. Incidentally, as becomes clear from the figure, one pressure chamber 113 and one piezoelectric element 117 are provided for each nozzle hole, whereas the ink flow channel 115 for supplying the ink is shared among a large number of the nozzle holes, and the ink is supplied from the flow channel through the ink supply hole 114 provided in each of the pressure chambers 113. FIG. 11C is a plan view seen from above the nozzle plate. In this example, there are two rows of 40 nozzle holes 121 aligned from left to right at about 340 μm intervals. In this figure, a line 120 surrounding each nozzle indicates the shape of the piezoelectric element present on the other side of the nozzle plate, and a broken line 124 indicates the shape of the ink follow channel. Since the ink is supplied from one ink flow channel to the 40 nozzle holes aligned from left to right, the ink of the same color is discharged from these 40 nozzle holes. Numeral 122 denotes an arrow indicating a feed direction of a substrate, and numeral 123 denotes the state in which the nozzles are aligned in two rows.

The following is a description of representative examples utilizing the ink jet printer as an electronic device producing apparatus. There is an example in which, by drawing metal colloid on a printed board by the ink jet method, a circuit pattern of lead wires is formed on the printed board (see Non-patent document 1 below). In order to form a lead wire circuit pattern on the printed board, a method usually adopted is a method including forming a metal film on the board and then forming the lead wire circuit pattern by photolithography or a method including forming a negative circuit pattern on the board with a resist film and then forming the lead wire circuit pattern by plating in a region without the resist, followed by removing the resist. The use of the ink jet method is advantageous in that the circuit can be formed on the printed board directly without conducting a troublesome photolithography process. Thus, it takes less time to form the circuit, making it possible to reduce the manufacturing cost considerably. Further, the photolithography requires a photo-mask (plate) corresponding to the circuit to be produced. Therefore, in the case of producing small batches of a variety of circuits and prototyping various circuits, it is necessary to produce a large number of photo-masks, thus consuming more time and cost. On the other hand, since the ink jet method requires no photo-mask, it is suitable for producing small batches of a variety of circuits and prototyping circuits.

Moreover, there are examples in which, by drawing functional organic molecules on a substrate by the ink jet method, a field effect transistor (see Non-patent document 2 below), a display utilizing electroluminescence (see Non-patent document 3 below) and a microlens array (see Non-patent document 4 below) are formed. The functional organic molecular thin film formed on the substrate tends to peel off from the substrate or have deteriorated electric characteristics when exposed to a developing agent or a peeling agent for the resist. Thus, it is difficult to form the pattern by a usual photolithographic process. Since the ink jet method allows the easy formation of patterns without deteriorating the characteristics of the functional organic molecules, it holds out a great promise as the method for producing an electronic device using the organic molecules.

Also, in recent years, as a means of examining a human physical predisposition, a disease diagnosis, an efficacy of a drug or the like at a genetic level, a DNA chip has been in wide use. The DNA chip is obtained by fixing several thousands to several tens of thousands of kinds of DNA fragments or synthetic oligonucleotides (in the following, referred to as "DNA probes") to a predetermined position on a several centimeters square glass substrate or silicon substrate and is used for determining many gene expressions at the same time or for checking whether or not a specific gene is present. A method of producing this DNA chip by the ink jet method has been suggested. That is, liquid in which the DNA probe is dissolved is placed at a predetermined position on the substrate by the ink jet method, making it possible to form a DNA chip in a simple manner at low cost (see Patent document 1 below).

In order to produce an electronic device or a DNA chip by the ink jet method, a liquid drop has to be placed accurately at a predetermined position on the substrate. In general, initial positions of the ink jet head and the substrate are set, and the liquid drop is discharged while shifting the relative positions between the head and the substrate by a preset amount, thereby placing the liquid at a predetermined position on the substrate. When the pattern of the liquid drops to be drawn is on the order of about several hundreds of μm, this method can achieve an accurate drawing. However, the initial positions and the moving amount of the ink jet head and the substrate vary in the range of μm due to the way the substrate is fixed and thermal expansion of the substrate caused by a temperature change. Therefore, it is difficult to draw a pattern in μm to several tens of μm by the above-described method.

Further, in the liquid discharge using the ink jet head, although with low frequency, the nozzle hole becomes clogged and the liquid is not discharged in some cases. For producing an electronic device and a DNA chip with excellent reproducibility, it also is important to detect whether or not the liquid drop is discharged properly.

Patent document 2 below suggests a spotting apparatus capable of fixing a reactant to a specific position in a detecting portion. In this patent, the position of a substrate is recognized by a vision camera disposed obliquely above the substrate on which the liquid drop is to be placed, thereby placing the liquid on the substrate accurately.

Further, Patent document 3 below suggests a DNA probe solution delivery device including an ink jet head having a plurality of nozzles discharging a DNA probe solution and a means of generating a drive signal for discharging liquid from a specified nozzle provided in the head, characterized by having a light-projecting means for projecting light toward the solution discharged from the nozzle and a light-receiving means for receiving the light from the light-transmitting means. The direction of the emitted light is parallel with a discharge surface of the ink jet head, and the light reflected by the liquid discharged from the head is received, thereby examining whether or not the solution is discharged normally.

Moreover, Patent document 4 below suggests a method for manufacturing an organic electroluminescence display device including, when forming an organic layer by discharging a liquid-phase organic material to a picture element on a substrate by an ink jet method, (a) forming an image recognition pattern on the substrate in advance, (b) recognizing the image recognition pattern using an image recognition device so as to obtain positional information of the substrate or the picture element, and (c) based on the positional information of the substrate or the picture element, controlling a positioning of an ink jet head and the substrate or the picture element and a timing of discharging the liquid-phase organic material. In this document, the image recognition device is disposed and fixed to the other side of the substrate with respect to the ink jet head, and a method of recognizing the image recognition pattern through a transparent or semi-transparent substrate is illustrated. In this conventional example, there is no disclosure about a placement position of the image recognition device with respect to the substrate and the illumination light required for recognizing the image.

From the result of examination conducted so far by the inventors of the present invention, it is understood that the space between the discharge port and the substrate has to be equal to or smaller than 1 mm in order to place a fine liquid drop pattern on the order of several hundreds of μm or smaller on the substrate. This is because, if the space is larger than this, the convection of the air changes the traveling direction of the liquid discharged from the discharge port by the time the liquid adheres to the substrate. Furthermore, if the space is larger, a minute liquid drop sometimes evaporates before adhering to the substrate.

In the apparatus shown in Patent document 2, since the vision camera is disposed obliquely above the substrate, when the space between the discharge port and the substrate is equal to or smaller than 1 mm, the position of the substrate immediately below the discharge port is difficult to see. Especially in the case of an ink jet head having a nozzle plate provided with the discharge ports in high density, it is impossible to detect the position of the substrate immediately below the nozzle holes near the center of the nozzle plate with the vision camera because of the obstruction by the edge of the nozzle plate.

Similarly, in the apparatus illustrated in Patent document 3, since the light parallel with the head has to be irradiated, the smaller space between the head and the substrate makes it difficult to bring the light between them.

In Patent document 4, since the vision camera is disposed on the other side of the substrate with respect to the ink jet head, the region in the substrate in which the liquid drop is to be placed can be observed even when the space between the ink jet head and the substrate is reduced. Now, in order to recognize the positions of the ink jet head and the substrate with the vision camera, it is necessary to project light to the ink jet head and the substrate using a light source and make the light reflected by the ink jet head and the substrate enter the vision camera. However, Patent document 4 fails to disclose how the light source is disposed. In general, a method of putting the light source between the vision camera and the substrate is used. However, this method makes it necessary to increase the distance between the substrate and the vision camera for disposing the light source. In the case where the region in the substrate to be recognized is on the order of about μm, a large-scale optical system is needed for capturing such a minute region with the vision camera, so that the entire apparatus becomes large. Accordingly, the position of the vision camera has to be fixed. The vision camera also is fixed in Patent document 3. In the case where only one of the substrate and the ink jet head moves, the relative positional relationship between the substrate and the ink jet head can be determined easily using a computation processing circuit based on the information obtained from the vision camera. On the other hand, in order to mass-produce electronic devices by the ink jet method, the speed of liquid drop placement has to be raised. Accordingly, it becomes essential to move the ink jet head and the substrate at the same time, while discharging the liquid drops from many nozzle holes at the same time. In this case, since the relative positional relationship between the vision camera and the substrate and that between the vision camera and the many nozzle holes vary from moment to moment, the computation processing circuit for determining the relative positional relationship between the substrate and the ink jet head becomes large. As a result, in the liquid drop placing apparatus of Patent document 4, the optical system and the computation processing circuit become large, leading to an increase in the price of the device.

Patent document 1: U.S. Pat. No. 5,658,802

Patent document 2: JP 2003-98172 A

Patent document 3: JP 2002-253200 A

Patent document 4: JP 2001-284047 A

Non-patent document 1: G. G. Rozenberg, Applied Physics Letters, vol. 81, 2002, p.p. 5249-5251

Non-patent document 2: H. Sirringhaus et al., Science, 2000, vol. 290, p.p. 2123-2126

Non-patent document 3: J. Bharathan et al., Applied Physics Letters, vol. 72, 1998, p.p. 2660-2662

Non-patent document 4: T. R. Hebner et al., Applied Physics Letters, vol. 72, 1998, p.p. 519-521

DISCLOSURE OF INVENTION

The present invention provides a liquid drop placing apparatus capable of adjusting accurately the relative position between an ink jet head and a substrate even when the distance between the ink jet head and the substrate is small and observing how the liquid drop is discharged. Further, the present invention provides a method for placing the liquid drop on the substrate accurately.

A liquid drop placing apparatus according to the present invention includes an ink jet head, a substrate receiving a liquid drop discharged from the ink jet head, a device for irradiating or reflecting light from a nozzle hole or its vicinity of the ink jet head toward the substrate, a position moving device for controlling a relative position between the ink jet head and the substrate, and a control device for discharging a liquid from the ink jet head. A light-receiving element for recognizing a position of the ink jet head is disposed behind the substrate, when seen from the ink jet head, the substrate has a transparency at least to a degree that the irradiated light or the light reflected from the nozzle hole or its vicinity toward the substrate enters the light-receiving element, and the light-receiving element senses the irradiated light or the light reflected from the nozzle hole or its vicinity toward the substrate.

A liquid drop placing method according to the present invention is a method in which a liquid is discharged from an ink jet head and placed on a surface of a substrate, including disposing a light-receiving element on a liquid discharge side of the ink jet head, disposing the substrate between the ink jet head and the light-receiving element, determining a position of the ink jet head with the light-receiving element before discharging the liquid, setting a relative position between the ink jet head and the substrate based on the determined information, and placing the liquid on the substrate.

DESCRIPTION OF THE INVENTION

Figure 1:
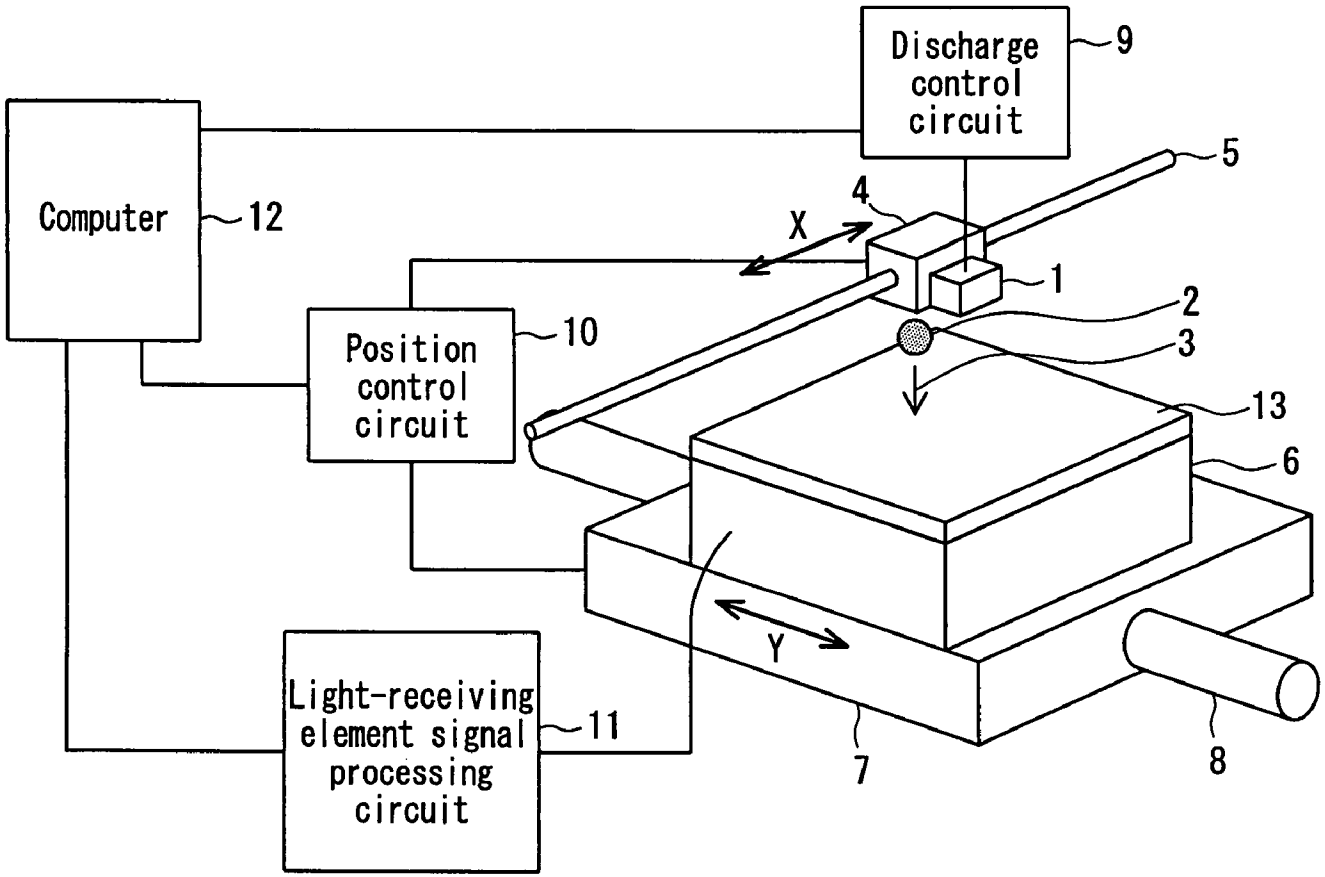
FIG. 1 is a schematic view showing a liquid drop placing apparatus in Embodiment 1 of the present invention.

The liquid drop placing apparatus according to the present invention includes the light-receiving element for recognizing the position of the ink jet head behind the substrate, when seen from the ink jet head. Also, the substrate has a transparency at least to a degree that the irradiated light or the light reflected from the nozzle hole or its vicinity of the ink jet head toward the substrate enters the light-receiving element. A higher transparency is more preferable, but no problem is caused even if the substrate is semi-transparent. It is appropriate that the substrate has a transparency to a degree that the light-receiving element can sense the irradiated light or the light reflected from the nozzle hole or its vicinity toward the substrate. As the substrate, it is preferable to use a glass substrate or a transparent resin substrate such as a polyester film substrate, a polyimide film substrate, an acrylic resin substrate or a polyolefin substrate.

The substrate may be fixed to a fixing stand provided separately. In the case where the fixing stand moves, it is preferable that the light-receiving element also moves as one piece with the fixing stand.

Also, in this liquid drop placing apparatus, it is preferable that a reflector plate that is semi-transparent to light is provided between the fixing stand and the light-receiving element, a light source is provided for making light parallel with a surface of the substrate fixed to the fixing stand incident onto the reflector plate, and the reflector plate is disposed and adjusted so as to reflect a part of the incident light in a direction of the ink jet head and transmit a part of the radiated light from the ink jet head on a side of the light-receiving element.

Further, in the liquid drop placing apparatus according to the present invention, it is preferable that the ink jet head includes a nozzle hole for discharging the liquid, a pressure chamber for generating a pressure for discharging the liquid from a nozzle, a flow channel for supplying the liquid to the pressure chamber, a container for storing the liquid and a tube for transporting the liquid from the container to the flow channel, a surface of the ink jet head that the liquid contacts is formed of a light-reflecting material, and a mechanism for bringing light from a light source into the container is provided.

Moreover, a method for placing a liquid drop on a substrate according to the present invention is a method in which a liquid is discharged from an ink jet head and placed on a surface of a substrate, including disposing a light-receiving element on a liquid discharge side of the ink jet head, disposing the substrate between the ink jet head and the light-receiving element, determining a position of the ink jet head with the light-receiving element before discharging the liquid, setting a relative position between the ink jet head and the substrate based on the determined information, and placing the liquid on the substrate.

By using the liquid drop placing apparatus according to the present invention, it is possible to produce an electronic device or a high-density DNA chip accurately. Furthermore, since a simple computation circuit is sufficient for determining the relative position between the optical system or the ink jet head and the substrate, the size and price of the apparatus can be reduced.

Embodiment 1

FIG. 1 is a schematic view showing an example of a liquid drop placing apparatus according to the present invention. A liquid drop 2 is discharged from an ink jet head 1 toward a substrate 13 as indicated by an arrow 3 and placed at a predetermined position in the fixed substrate 13. The ink jet head 1 is fixed to a carriage 4, which moves in an X-axis direction along a carriage shaft 5. A discharge control circuit 9 controls the timing of discharging the liquid drop 2 from the ink jet head 1, the size of the liquid drop 2, an initial speed and the number of the liquid drops 2 discharged per second. The substrate 13 is located immediately above a light-receiving element 6, and the substrate 13 and the light-receiving element 6 move as one piece in a Y-axis direction with a moving stage 7 moving along a carriage shaft 8. It is desired that the substrate 13 be formed of a light-transmitting material. The carriage shaft 8 and the moving stage 7 move individually while being controlled by a position control circuit 10. The information about the intensity and incident position of light entering the light-receiving element 6 is supplied from a light-receiving element signal processing circuit 11.

Figure 2:
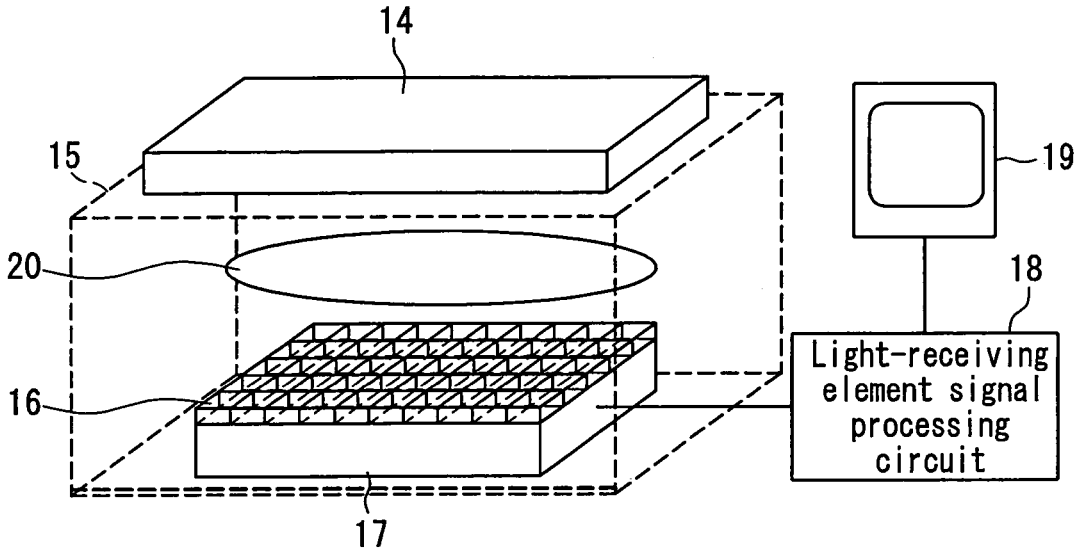
FIG. 2 is a schematic view showing a relationship between a substrate and a light-receiving element in the liquid drop placing apparatus in Embodiment 1 of the present invention.

As shown in FIG. 2, which will be described later, owing to a mechanism of allowing radiation light from a nozzle hole for discharging a liquid drop or its vicinity to enter the light-receiving element, it is possible to determine the positional relationship between the ink jet head 1 and the light-receiving element 6 shown in FIG. 1 and the positional relationship between the substrate 13 and the light-receiving element 6 utilizing this light. Further, from these two pieces of information, the positional relationship between the ink jet head and the substrate can be determined. In the present example, since the mechanism in which the light radiates from the nozzle hole or its vicinity toward the light-receiving element is provided, there is no need to provide a large clearance between the light-receiving element 6 and the substrate 13 for accommodating a light source. Accordingly, the space between the substrate 13 and the light-receiving element 6 can be reduced, so that a large-scale optical system becomes unnecessary. Therefore, the substrate 13 and the light-receiving element 6 can be moved as one piece. As a result, even when the ink jet head 1 and the substrate 13 move at the same time, the relative positional relationship between them can be determined using a simple computation circuit.

The position control circuit 10, the light-receiving element signal processing circuit 11 and the discharge control circuit 9 are controlled by a computer 12 in a centralized manner. Consequently, it is possible to examine the positional relationship between the ink jet head 1 and the substrate 13 with the light-receiving element 6 and move the ink jet head 1 and the substrate 13 to predetermined positions based on this information so as to discharge the liquid drop 2, thereby placing the liquid drop 2 accurately at a predetermined position on the substrate 13. Also, the liquid drop 2 discharged from the nozzle hole can be observed with the light-receiving element 6, so that how the liquid drop 2 is discharged can be examined.

The light-receiving element 6 in the present invention refers to optical sensors for receiving light that are aligned within a two-dimensional plane, and measures the intensity of light entering each sensor. Representative examples thereof include a charge-coupled device (CCD) imaging element and a metal-oxide semiconductor (MOS) imaging element.

FIG. 2 is a schematic view for specifically describing only a portion of the substrate 13 and the light-receiving element 6 in the liquid drop placing apparatus shown in FIG. 1. Individual optical sensors 16 are held by an optical sensor supporting portion 17 and aligned in a lattice form within a plane. When light reaches any of the optical sensors 16, light energy is converted into electronic energy in the optical sensor 16, so that an electric current is generated. The electric current generated in each element goes to the light-receiving element signal processing circuit 18 and is amplified and computed. The light-receiving element signal processing circuit 18 outputs the information about the position of the optical sensor 16 that has received the light and the intensity of this light to the outside as an electric signal. This outputted electric signal is computed by a computer 19, thereby obtaining the information about the light that has entered the optical sensor 16 (the light-receiving element). By disposing an objective lens 20 above the optical sensor 16 and adjusting the distance between them so as to focus an image of the ink jet head above the optical sensor 16 onto the optical sensor, it becomes possible to determine the positional relationship between the ink jet head and each optical sensor 16. If the positions of a substrate 14 and the optical sensor 16 (the light-receiving element) and the positional relationship between a nozzle hole of the ink jet head and the optical sensor 16 (the light-receiving element) are set in advance, the positional relationship between the nozzle hole and the substrate also can be determined, so that the position of the substrate to which the liquid drop is to be discharged can be determined. Numeral 15 denotes the overall light-receiving element.

Even when the positions of the substrate and the light-receiving element are not set strictly in advance, the positional relationship between the ink jet head and the substrate also can be examined by the following method. That is, after the positional relationship between the nozzle hole and the imaging element is determined by focusing the image of the nozzle hole of the ink jet head onto the optical sensor, the positional relationship between the substrate and the imaging element is determined similarly by focusing the image of the substrate onto the imaging element. From these two pieces of information, the positional relationship between the nozzle hole and the substrate can be determined.

Embodiment 2

Embodiment 2 illustrates one method for radiating light from a nozzle hole of an ink jet head or the vicinity of the nozzle. In other words, in Embodiment 1, a reflector plate that is semi-transparent to light is provided between the fixing stand and the light-receiving element, a light source is disposed so that light parallel with the surface of the substrate fixed to the fixing stand enters the reflector plate, and the orientation of the reflector plate is adjusted so that the reflector plate reflects a part of the incident light toward the ink jet head and transmits a part of the radiant light from the ink jet head to the side of the light-receiving element.

Figure 3A:
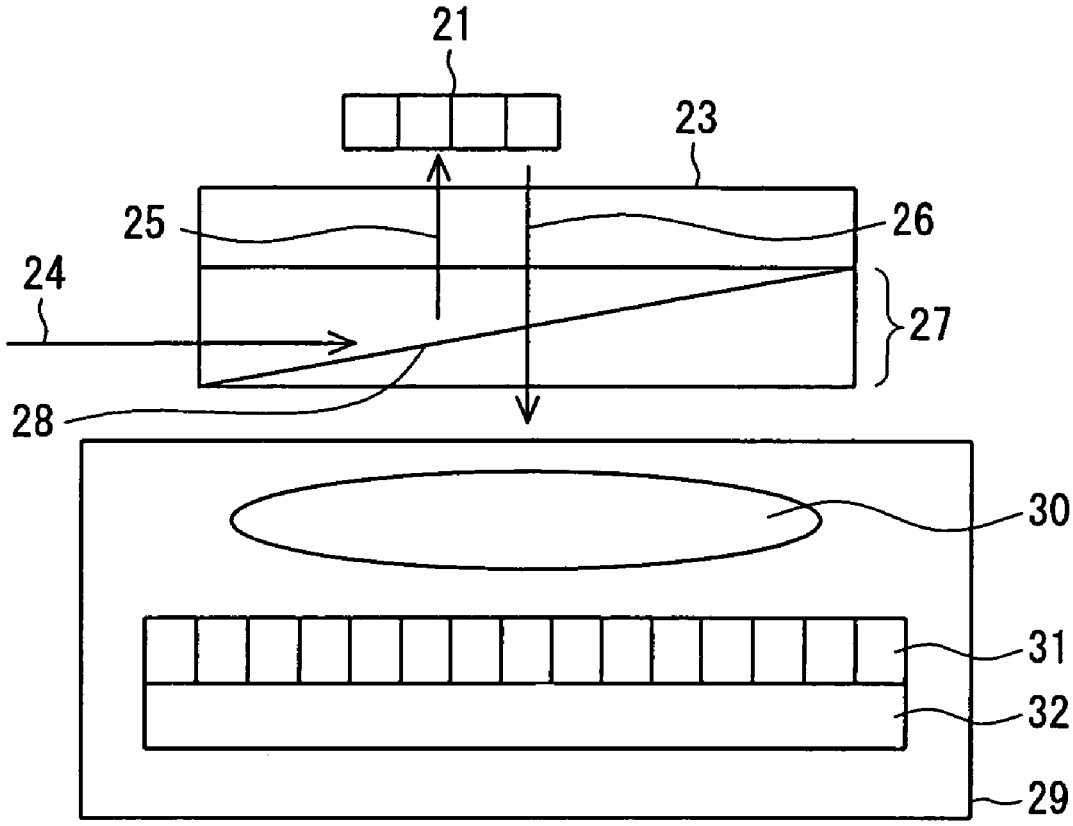
FIG. 3A is a schematic view showing a liquid drop placing apparatus in Embodiment 2 of the present invention.

FIG. 3A is a schematic view showing an example of the present embodiment. Immediately below a transparent substrate 23, an optical unit 27 including a reflector plate 28 is provided. The reflector plate 28 is semi-transparent to light, and incident light 24 entering in parallel with the surface of the substrate 23 is reflected by the reflector plate 28 and turns into reflected light 25 heading toward an ink jet head 21. This reflected light 25 is reflected by a nozzle plate 33 and the substrate 23, turns into reflected light 26, is transmitted by the reflector plate 28, passes through an objective lens 30 and forms images of the nozzle plate 33 and the substrate 23 on an optical sensor 31. Numeral 32 denotes an optical sensor supporting portion, and numeral 29 denotes an overall light-receiving element.

Figure 3B:
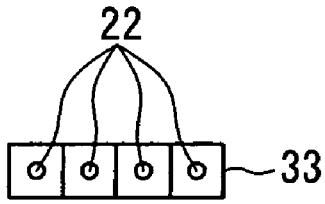
FIG. 3B is a bottom view showing an ink jet head shown in FIG. 3A.

FIG. 3B is a bottom view of the ink jet head 21 shown in FIG. 3A, and shows the nozzle plate 33 having a plurality of nozzle holes 22.

Embodiment 3

Embodiment 3 illustrates another method for radiating light from the nozzle hole or its vicinity toward the light-receiving element. In other words, Embodiment 3 provides an ink jet head including a mechanism of radiating light from the nozzle hole toward the substrate. This ink jet head is constituted by nozzle holes for discharging liquid, a pressure chamber for generating a pressure for discharging the liquid from the nozzle, a flow channel for supplying the liquid to the pressure chamber, a container for storing the liquid and a tube for transporting the liquid from the container to the flow channel. In the ink jet head, the surface that the liquid contacts is formed of a light-reflecting material, and a mechanism of bringing light from a light source into the container is provided.

Figure 4:
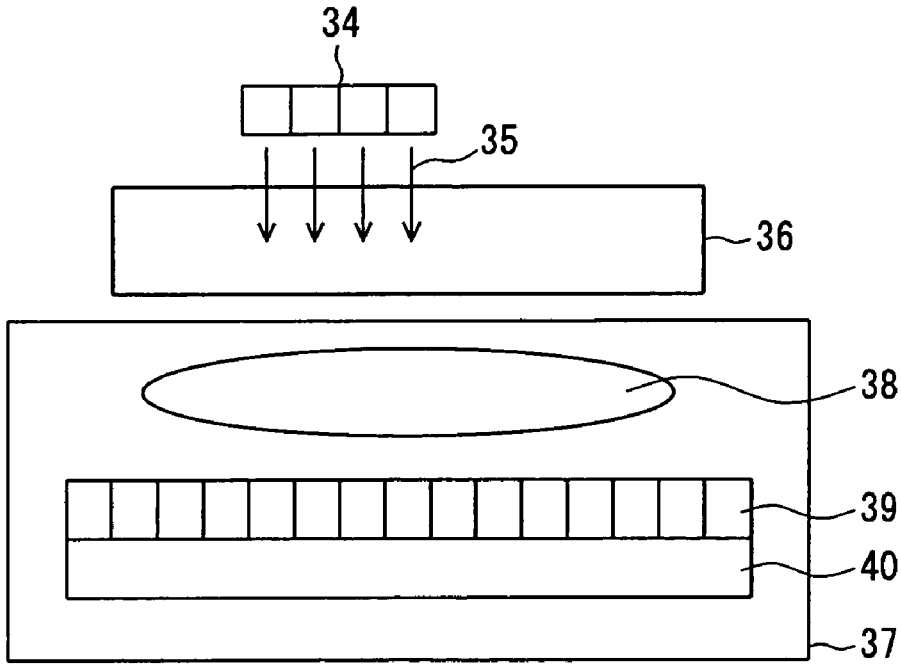
FIG. 4 is a schematic view showing a liquid drop placing apparatus in Embodiment 3 of the present invention.

FIG. 4 is a schematic view showing an example of a liquid drop placing apparatus using the ink jet head illustrated in the present embodiment. Light 35 is irradiated from nozzle holes of an ink jet head 34 toward a transparent substrate 36. The irradiated light 35 passes through an objective lens 38 and enters an optical sensor 39, so that the positional relationship between the nozzle hole and the light-receiving element can be determined. Also, by projecting this light to the substrate 36, it also becomes possible to determine the positional information of the substrate 36 by the optical sensor (light-receiving element) 39. Numeral 40 denotes an optical sensor supporting portion, and numeral 37 denotes an overall light-receiving element.

Figure 5:
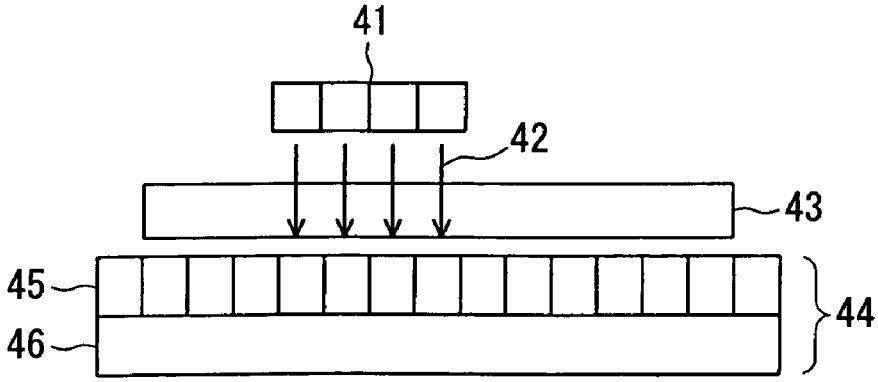
FIG. 5 is a schematic view showing a liquid drop placing apparatus in Embodiment 3 of the present invention.

FIG. 5 illustrates another example of detecting the positions of an ink jet head 41 and a substrate 43 by radiating light 42 from a nozzle of the ink jet head 41. This example is basically the same as that illustrated in FIG. 4 but is characterized in that no objective lens is provided. By reducing the distance between an optical sensor 45 and the ink jet head 41, it becomes possible to detect the position of the nozzle hole without using an objective lens. Numeral 46 denotes an optical sensor supporting portion, and numeral 44 denotes an overall light-receiving element.

Figure 6:
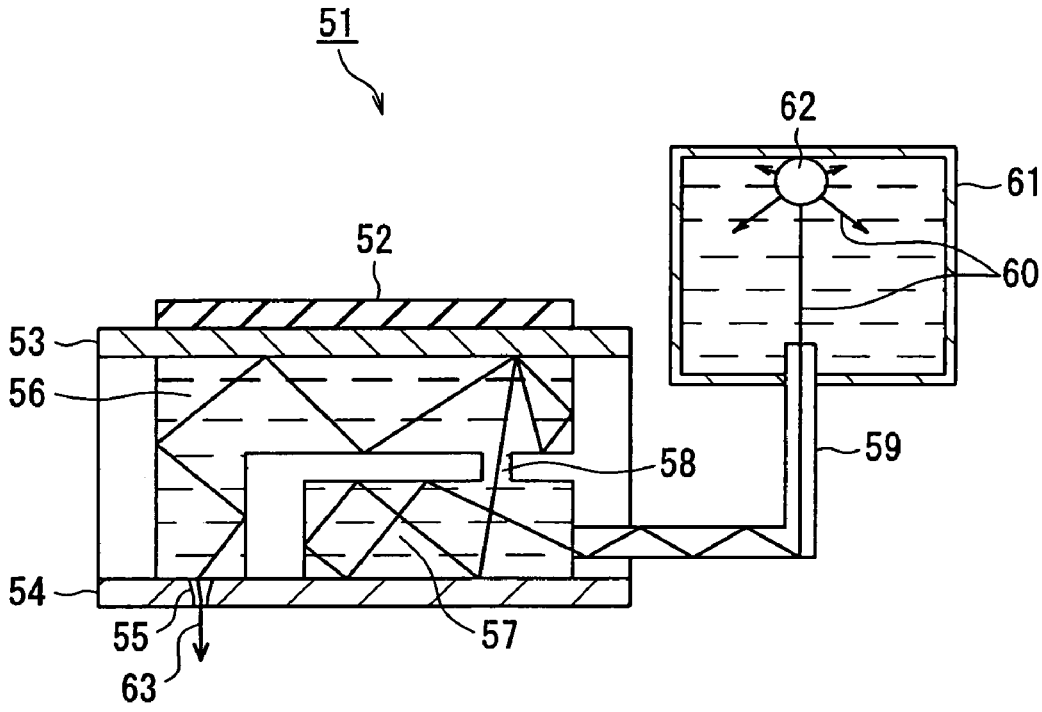
FIG. 6 is a schematic sectional view showing an ink jet head in Embodiment 3 of the present invention.

FIG. 6 is a schematic view showing a specific structure of an ink jet head 51 used in the present embodiment. An inner wall of a nozzle hole 55 provided in a nozzle plate 54, an inner wall of a pressure chamber 56, an inner wall of an ink flow channel 57, an inner wall of a tube 59 and an inner wall of a liquid storage container 61 are formed of a light-reflecting material. For forming each of these inner walls of such a material, it is appropriate to provide a metal having a high light reflectivity onto these inner walls by vapor deposition or plating. The metal used here can be aluminum, platinum, gold or the like. When a light source 62 is provided inside the liquid storage container 61 so as to radiate light, a light beam 60 emitted from the light source is reflected by the inner wall of the tube 59, the inner wall of the ink flow channel 57, the inner wall of the pressure chamber 56 and the inner wall of the nozzle hole 55 and finally emitted outward from the nozzle hole 55 so as to become emitted light 63. The light source 62 does not have to be disposed in the liquid storage container 61 but may be, for example, disposed outside the container so that the light is guided into the container through an optical fiber. Numeral 52 denotes a piezoelectric element, numeral 53 denotes a diaphragm, and numeral 58 denotes an ink supply port.

Figure 7:
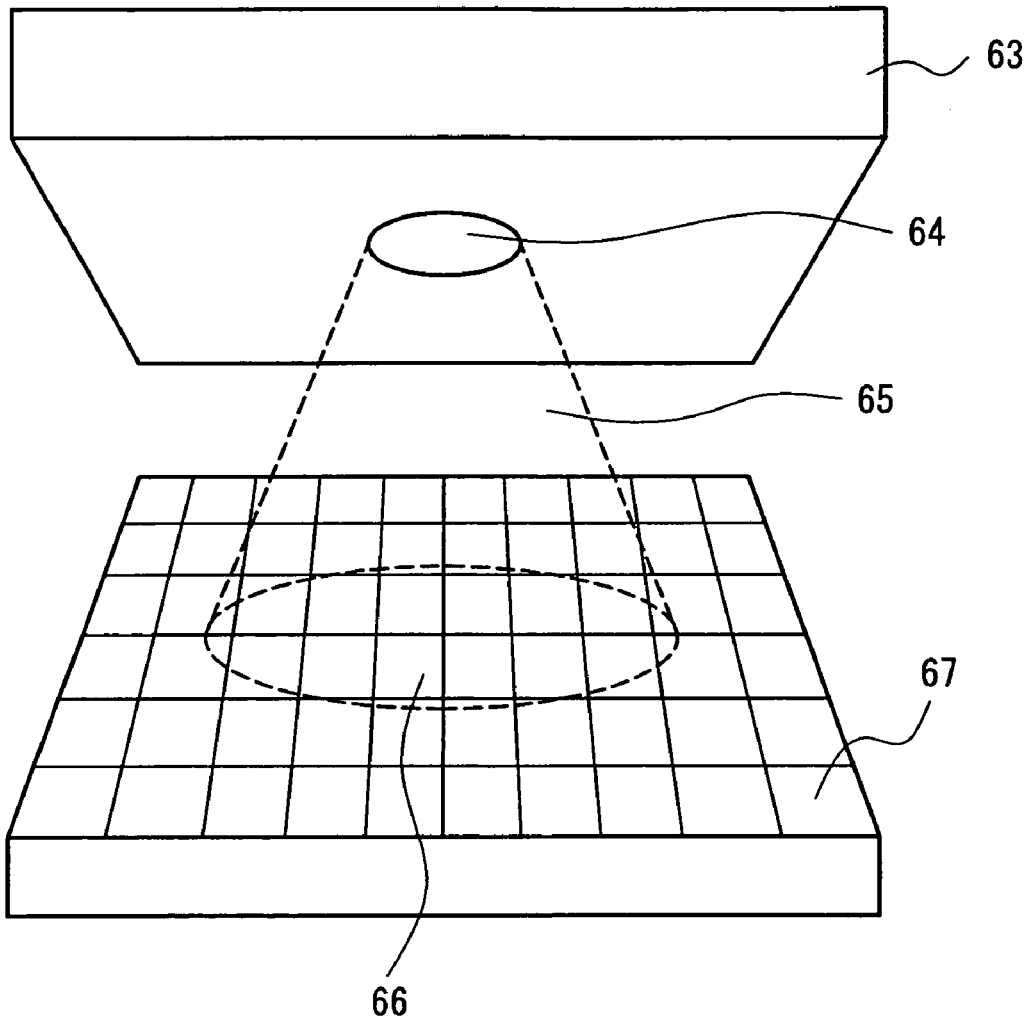
FIG. 7 is a schematic view showing how light emitted from a nozzle hole of the ink jet head in Embodiment 3 of the present invention is received by optical sensors.

FIG. 7 schematically shows the shape of light flux radiating from a nozzle hole 64. When the shape of the nozzle hole 64 penetrating through a nozzle plate 63 is symmetrical with respect to a central axis passing through the center of the nozzle hole 64, light flux 65 radiating from the nozzle hole 64 is symmetrical with respect to the central axis of the nozzle hole 64. Thus, this light flux 65 is projected onto the surface of a group of optical sensors 67 and forms a circular spot 66. Since a point immediately above the central point of this circular spot 66 matches the central portion of the nozzle hole 64, it becomes possible to detect the central position of the nozzle hole 64.

In the following, specific examples of the present invention will be described. It should be noted that the present invention is not limited to the examples below.

EXAMPLE 1

Using a liquid drop placing apparatus, liquid was placed within circular regions with a diameter of 50 μm at 100 μm intervals on a 10 mm×10 mm glass substrate 0.2 mm in thickness. Details will be described below.

(1) Method for Producing Substrate

A 10 mm×10 mm quartz glass substrate 0.2 mm in thickness was cleaned ultrasonically with a neutral detergent and then rinsed with running pure water. This glass substrate was dried by blowing a nitrogen gas and then irradiated with ultraviolet light in an ozone atmosphere at 110° C., thereby removing organic substances remaining on the surface of the glass substrate. Thereafter, by a usual photolithographic process, positioning marks (alignment marks) of chromium were formed at four corners of the glass substrate. The alignment marks had a cruciform shape formed of two rectangles 100 μm in length and 10 μm in width crossing at right angles. Next, a positive resist film pattern was formed on this glass substrate. This was a pattern in which circular resist films with a diameter of 50 μm were arranged at 100 μm intervals in a lattice form. The positional relationship between the alignment marks formed at the four corners of the glass substrate and the circles was set to a predetermined value. In other words, if the positions of the alignment marks at the four corners were figured out, then it was possible to determine the position of a predetermined circle uniquely.

Next, in a glove box filled with a dry nitrogen gas, the glass substrate was immersed for 1 hour in a mixed solution of n-hexadecane and chloroform (volume ratio: 8 to 2) in which 1 vol % of hexadecafluoroethyltrichlorosilane ($CF_3(CF_2)_7C_2H_4SiCl_3$ (in the following, referred to as "FACS")) was dissolved. Thereafter, this glass substrate was washed with toluene. Consequently, FACS was adsorbed in a region without the resist.

Subsequently, the treated glass substrate was taken out from the glove box and immersed in acetone so as to remove the resist film on the glass substrate. Since the FACS adsorbed onto the glass substrate was not removed by the acetone immersion, only the regions from which the resist was removed became hydrophilic. As a result, a hydrophilic/hydrophobic pattern was formed in which circles with a diameter of 50 μm serving as the hydrophilic regions were located at 100 μm intervals and the region other than the hydrophilic regions was hydrophobic. Incidentally, the static contact angles of the hydrophobic region and the hydrophilic region with respect to pure water were 5° and 130°, respectively.

(2) Optical Sensor

As an optical sensor, a charge-coupled device (CCD) manufactured by Matsushita Electric Industrial Co., Ltd. was used. The specification thereof was as follows.

The number of sensors: 30,000

Figure 11A:
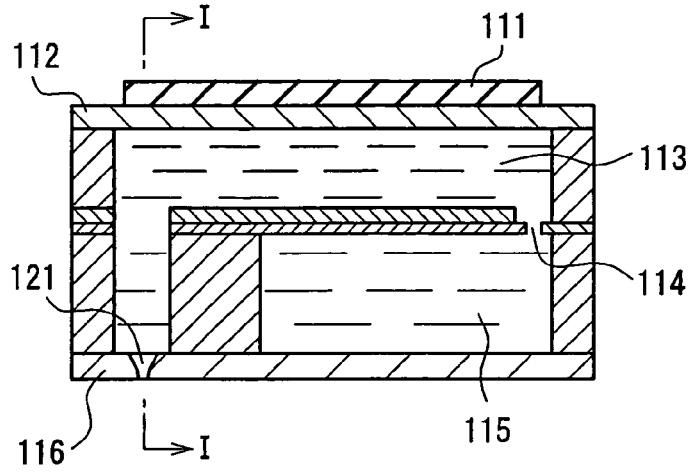
FIGS. 11A to 11C are schematic views showing an ink jet head used conventionally and also used in Example 1 of the present invention, with FIG. 11A being a schematic sectional view showing the ink jet head in the vicinity of a nozzle hole, FIG. 11B being a schematic three-dimensional perspective drawing taken along a line I-I shown in FIG. 11A and FIG. 11C being a schematic view showing the ink jet head seen from a side of a nozzle plate.
Figure 11B:
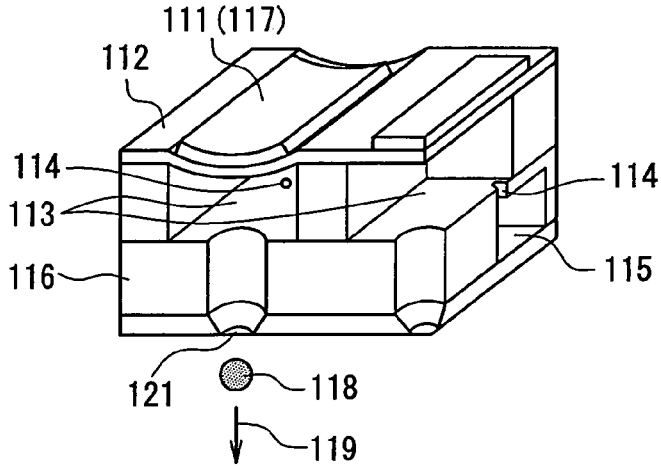
Figure 11C:
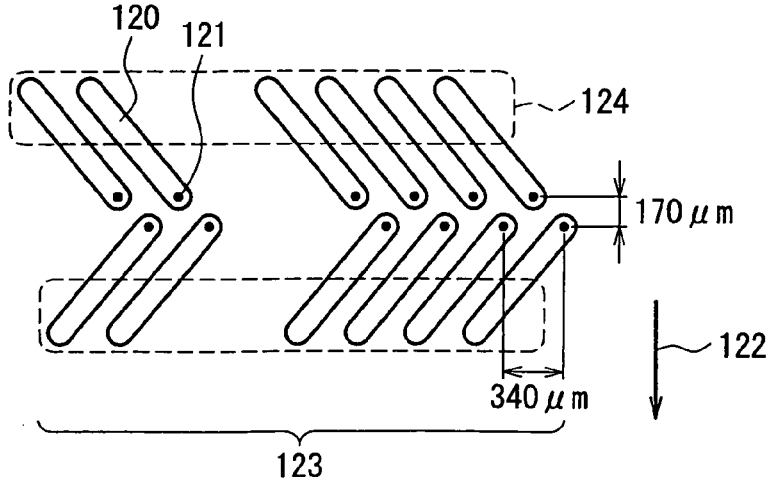

Dimension of one sensor and its peripheral portion: 60 μm×60 μm, length by width Dimension of entire sensor: 15 mm×15 mm, length by width (3) Ink Jet Head A general ink jet head shown in FIGS. 11A to 11B was used. A diaphragm was formed of copper and had a thickness of 3 μm, and a piezoelectric element was formed of lead zirconate titanate (PZT) and had a thickness of 3 μm. PZT was formed by vacuum sputtering and had a (001) orientation in a direction perpendicular to the film. A nozzle plate was treated to be water repellent. The nozzle hole had a diameter of 20 μm and was formed by an electrodischarge machining process. Also, as shown in FIG. 11C, 40 nozzles discharged ink of the same color and were arranged from left to right at 340 μm intervals. Then, five rows of the 40 nozzles were arranged from top to bottom at 170 μm intervals. The total number of nozzle holes was 200. In the present example, only one nozzle hole was used to discharge the liquid. The liquid was discharged by applying a voltage at a frequency of 10 KHz and an amplitude of 20 V between the piezoelectric elements. The amount of the liquid drop was 20 picoliters (about 16.8 μm in radius). Instead of the ink, predetermined liquid was put in the ink jet head.

(4) Liquid Drop Placing Apparatus

Figure 8:
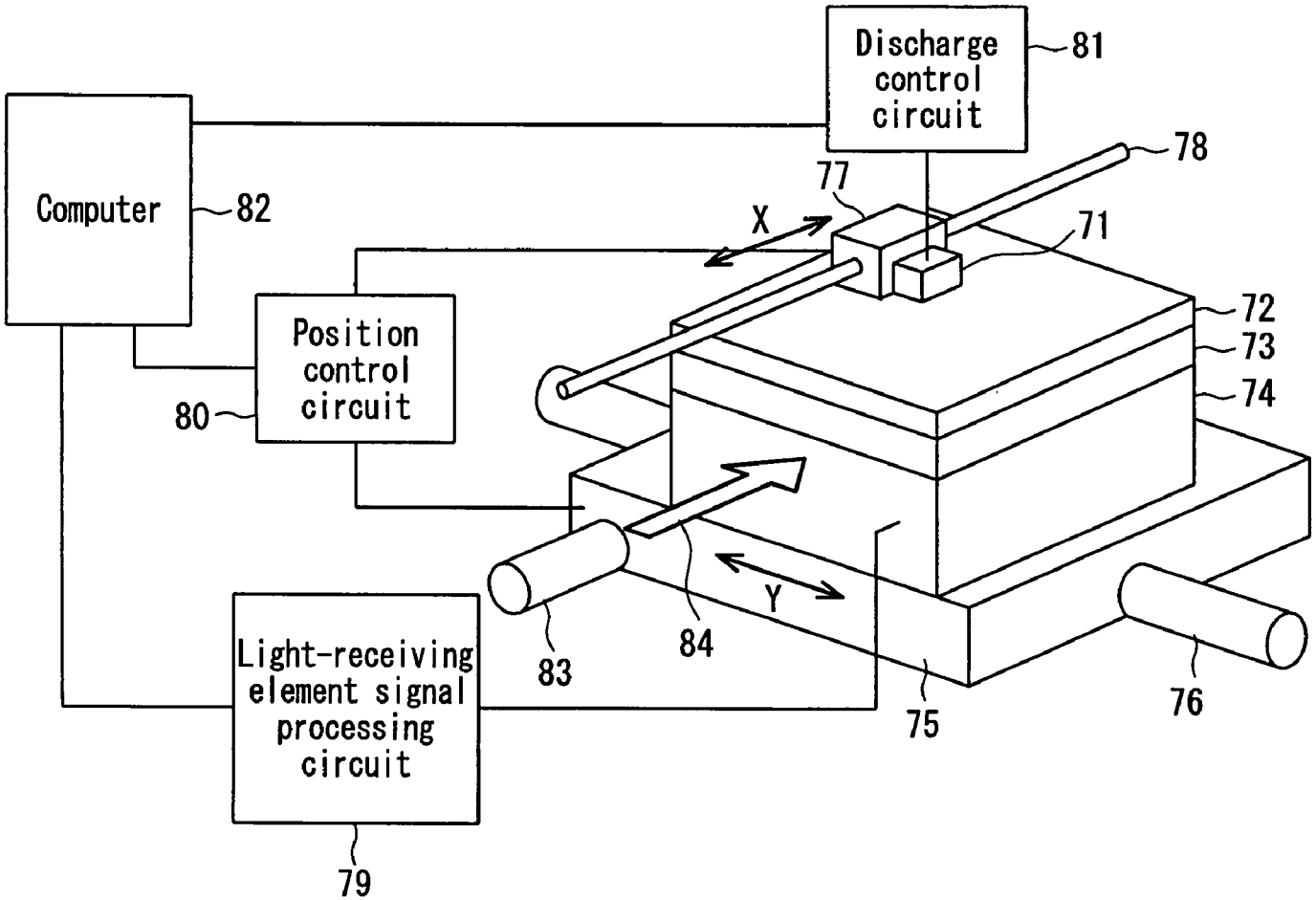
FIG. 8 is a schematic view showing a liquid drop placing apparatus in Example 1 of the present invention.

FIG. 8 is a conceptual diagram of a liquid drop placing apparatus according to the present example, which was the same as the liquid drop placing apparatus shown in FIG. 1 except that a light reflecting unit 73 and a light source 83 were added. A light-receiving element 74, the light reflecting unit 73 and a glass substrate 72 were disposed in this order on a moving stage 75, which moved in a Y-axis direction along a carriage shaft 76. An ink jet head 71 moved in an X-axis direction on a carriage shaft 78 together with a carriage 77. The distance between a nozzle plate of the ink jet head 71 and the glass substrate 72 was set to 0.3 mm. Further, incident light 84 parallel with the surface of the glass substrate 72 was guided from the light source 83 to the light reflecting unit 73. In the present example, a halogen lamp was used as the light source. Numeral 79 denotes a light-receiving element signal processing circuit, numeral 80 denotes a position control circuit, numeral 81 denotes a discharge control circuit, and numeral 82 denotes a computer.

Figure 9:
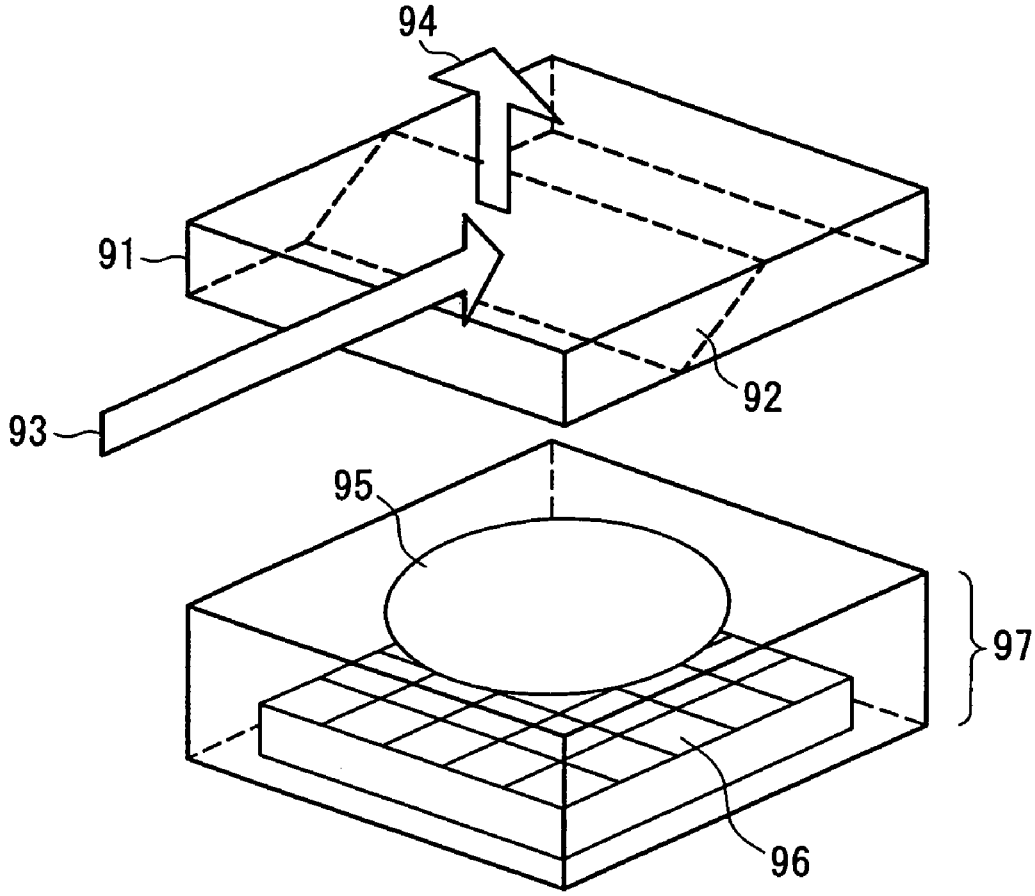
FIG. 9 is a schematic view showing details of a light reflecting unit and a light-receiving element in the liquid drop placing apparatus in Example 1 of the present invention.
Figure 10:
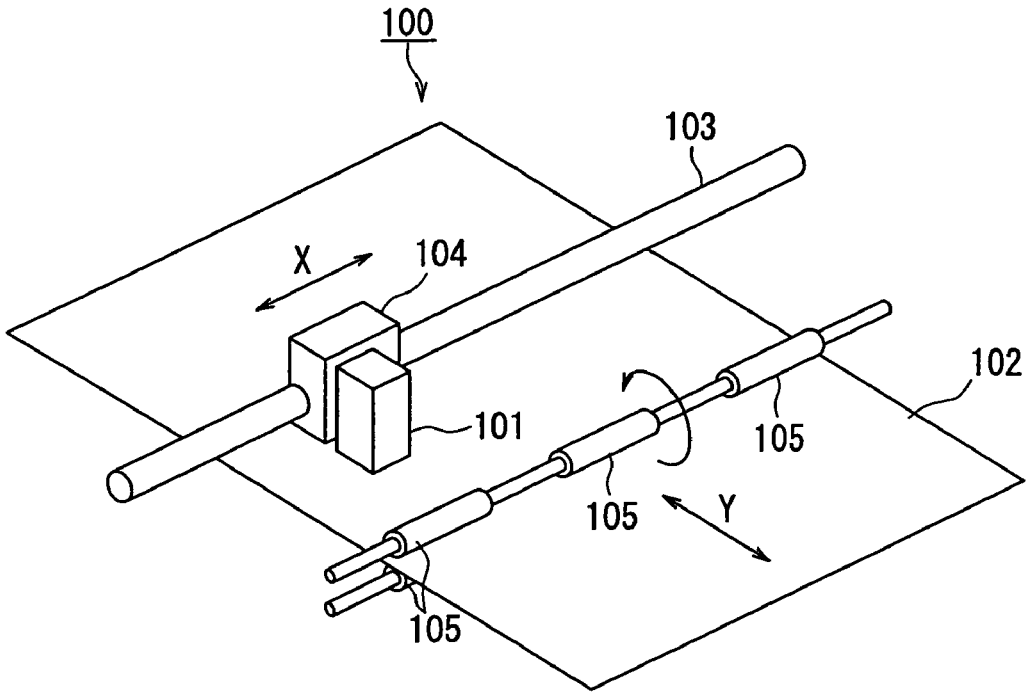
FIG. 10 is a schematic view showing an entire conventional ink jet printer.

FIG. 9 is a schematic view describing the structure of a light-receiving element and a light reflecting unit in detail. A light reflecting unit 91 was provided with a reflector plate 92 for reflecting light. This reflector plate 92 was semi-transparent to light, and reflected a part of incident light 93 parallel with the surface of the glass substrate so as to turn it into reflected light 94 and transmitted a part of the light as it was. The reflected light 94 passed through a glass substrate provided above (not shown), reached a nozzle plate (not shown) of an ink jet head (not shown), turned into reflected light and returned to the reflector plate again. A part of this light entered a light-receiving element 97. The light-receiving element 97 was constituted by a CCD, which was a group of optical sensors 96, and an objective lens 95 provided above the CCD. The distance between the objective lens 95 and the CCD was controlled by an electromagnetic motor.

(5) Liquid to be Placed on Glass Substrate

Single-stranded oligonucleotide formed of 10 bases whose terminal end was fluorescent-labeled with fluorescein isothiocyanate (FITC) (manufactured by Wako Pure Chemical Industries, Ltd.) was dissolved in pure water so as to achieve a concentration of 20 wt %. This was inserted in an ink chamber of the ink jet head.

(6) How to Place Liquid on Glass Substrate

Referring to FIG. 8, how to place liquid will be explained. After the incident light 84 was made to enter from the light source 83 to the light reflecting unit 73, the distance between the objective lens (indicated by numeral 95 in FIG. 9) and the CCD was adjusted so that the image of the alignment marks on the surface of the glass substrate 72 was focused onto the CCD element 74. As a result, the positional relationship between the alignment marks and the CCD element was determined. Similarly, the objective lens was moved so that the image of the nozzle hole of the nozzle plate discharging the liquid was focused onto the CCD element, thereby determining the positional relationship between the nozzle hole and the CCD element. From these determinations, it was possible to determine the positional relationship between each hydrophilic region on the glass substrate 72 and the nozzle hole. Next, the ink jet head 71 and the glass substrate 72 were moved so that the nozzle hole discharging the liquid was located immediately above the hydrophilic region on the glass substrate 72 on which the liquid was to be placed. Then, the liquid drop was discharged from the ink jet head 71 by the control circuit 81. Similarly, the ink jet head 71 was moved, thereby placing the liquid in the next hydrophilic region. By repeating this, the liquid was placed in all of the hydrophilic regions on the glass substrate 72.

How the liquid drop was placed from the ink jet head 71 on the substrate was observed at the moment using the light-receiving element, the light-receiving element signal processing circuit 79 and the computer 82. In other words, by achieving a focus on the image of the nozzle hole, it was possible to observe how the liquid was discharged from the nozzle hole. As a result, it was found to be possible to observe whether or not the liquid was discharged from the nozzle hole at the moment.

(7) Method and Result of Evaluating Placed Liquid

Since oligonucleotide placed on the glass substrate was labeled with a fluorescent substance, it was possible to evaluate the shape of the placed liquid drop by observing the fluorescence with a fluorescence microscope. The glass substrate was irradiated with a laser beam at a wavelength of 400 nm, thus observing the fluorescence at 520 nm.

As a result, it was confirmed that the fluorescence was emitted from the circular regions with a diameter of 50 μm and these regions were arranged at 100 μm intervals.

EXAMPLE 2

The liquid drop was placed similarly to Example 1. However, the ink jet head was as follows.

(1) Ink Jet Head

An ink jet head having the structure shown in FIG. 6 in Embodiment 3 was used. A halogen lamp was used as the light source. Further, aluminum was provided on the inner wall of the head by vacuum deposition.

(2) How to Place Liquid on Glass Substrate

The space between the objective lens and the imaging element was adjusted so as to focus the nozzle hole radiating light onto the surface of the CCD element, thereby determining the positional relationship between the nozzle hole and the imaging element. Next, the ink jet head, the substrate and the imaging element were moved so that the light radiating from the nozzle hole reached the alignment mark on the substrate. Incidentally, the substrate and the imaging element were moved as one piece. Subsequently, the image of the alignment mark on the substrate was focused onto the CCD element, thus determining the positional relationship between the alignment mark and the imaging element. Based on the information of these two positional relationships, the positional relationship between the nozzle hole and the substrate was determined. Thereafter, based on this information, the liquid drop was placed in the hydrophilic regions on the substrate.

(3) Method and Result of Evaluating Placed Liquid

The liquid drop placed on the glass substrate was evaluated similarly to Example 1. As a result, similarly to Example 1, it was confirmed that the fluorescence was emitted from the circular regions with a diameter of 50 μm and these regions were arranged at 100 μm intervals.

EXAMPLE 3

The liquid drop was placed on the glass substrate similarly to Example 2. However, the objective lens was removed from the imaging element. Also, the CCD element was brought into contact with the glass substrate.

Similarly to Example 2, the relative position between the nozzle hole and the substrate was determined, thus placing the liquid drop at a predetermined position. As a result, similarly to Example 2, it was confirmed that the liquid drop was placed accurately at a predetermined position.

INDUSTRIAL APPLICABILITY

The present invention makes it possible to place minute liquid drops on a substrate with high precision, so that a minute liquid drop pattern can be formed on the substrate with high precision. The liquid drop to be discharged can be a DNA probe, a protein, a semiconductor material, a lens material and a metallic material so as to form a DNA chip, a biochip, a semiconductor element such as a thin-film transistor, a lens and a wiring. Consequently, in accordance with the present invention, it is possible to achieve a DNA chip, a biochip and an electronic element, etc.

Incidentally, although the piezoelectric element was used as a pressure generating mechanism of the ink jet head in the examples of the present invention, there is no particular limitation to this. It also is possible to use a method of generating air bubbles momentarily by a thermic effect (the Bubble Jet (registered trademark) method).

Furthermore, although the liquid drop was discharged from only one nozzle hole in the examples of the present invention, the liquid drops also may be discharged at the same time from a large number of the nozzle holes.

The invention claimed is:

1. A liquid drop placing apparatus comprising:

an ink jet head;

a substrate receiving a liquid drop discharged from the ink jet head;

a device for irradiating or reflecting light from a nozzle hole or its vicinity of the ink jet head toward the substrate;

a position moving device for controlling a relative position between the ink jet head and the substrate; and a control device for discharging a liquid from the ink jet head;

wherein a light-receiving element for recognizing a position of the ink jet head is disposed behind the substrate, when seen from the ink jet head, the substrate has a transparency at least to a degree that the irradiated light or the light reflected from the nozzle hole or its vicinity toward the substrate enters the light-receiving element, and the light-receiving element senses the irradiated light or the light reflected from the nozzle hole or its vicinity toward the substrate, wherein the ink jet head comprises a system for irradiating light from an inside of the nozzle hole discharging the liquid toward the substrate, and wherein the system for irradiating the light from the inside of the nozzle hole toward the substrate comprises the nozzle hole, a pressure chamber for generating a pressure for discharging the liquid from a nozzle, a flow channel for supplying the liquid to the pressure chamber, a container for storing the liquid and a tube for transporting the liquid from the container to the flow channel, and a surface that the liquid contacts is formed of a light-reflecting material, and light from a light source is brought into the container and guided to the nozzle hole.

2. The liquid drop placing apparatus according to claim 1, further comprising a system for moving the light-receiving element as one piece with the substrate with a movement of the substrate.

3. The liquid drop placing apparatus according to claim 1, wherein a reflector plate that is semi-transparent to light is provided between the substrate and the light-receiving element, a light source is provided for making light parallel with a surface of the substrate incident onto the reflector plate, and the reflector plate is disposed and adjusted so as to reflect a part of the incident light in a direction of the ink jet head and transmit a part of the light reflected from the ink jet head on a side of the light-receiving element.

4. The liquid drop placing apparatus according to claim 1, wherein the substrate is a glass or a resin.

5. The liquid drop placing apparatus according to claim 1, wherein the ink jet head is a head for discharging the liquid by a vibration using a piezoelectric element or a head for discharging the liquid by an air bubble generation caused by a thermic effect.

6. A liquid drop placing method in which a liquid is discharged from an ink jet head and placed to a surface of a substrate, the method comprising:

disposing a light-receiving element on a liquid discharge side of the ink jet head;

disposing the substrate between the ink jet head and the light-receiving element before discharging the liquid;

setting a relative position between the ink jet head and the substrate based on the determined information, and placing the liquid to the substrate, wherein the ink jet head comprises a system for irradiating light from an inside of a nozzle hole discharging the liquid toward the substrate, and wherein the system for irradiating the light from the inside of the nozzle hole toward the substrate comprises the nozzle hole, a pressure chamber for generating a pressure for discharging the liquid from a nozzle, a flow channel for supplying the liquid to the pressure chamber, a container for storing the liquid and a tube for transporting the liquid from the container to the flow channel, and a surface that the liquid contacts is formed of a light-reflecting material, and light from a light source is brought into the container and guided to the nozzle hole.

7. A liquid drop placing method according to claim 6, further comprising a system for moving the light-receiving element as one piece with the substrate with a movement of the substrate.

8. The liquid drop placing method according to claim 6, wherein a reflector plate that is semi-transparent to light is provided between the substrate and the light-receiving element, a light source is provided for making light parallel with the surface of the substrate incident onto the reflector plate, and the reflector plate is disposed and adjusted so as to reflect a part of the incident light in a direction of the ink jet head and transmit a part of the light reflected from the ink jet head on a side of the light-receiving element.

9. The liquid drop placing method according to claim 6, wherein the substrate is a glass or a resin.

10. The liquid drop placing method according to claim 6, wherein the ink jet head is a head for discharging the liquid by a vibration using a piezoelectric element or a head for discharging the liquid by an air bubble generation caused by a thermic effect.

* * * * *